US009866966B2

(12) United States Patent
Lott

(10) Patent No.: US 9,866,966 B2
(45) Date of Patent: Jan. 9, 2018

(54) WIRELESS AUDIO SYSTEM

(71) Applicant: Fender Musical Instruments Corporation, Scottsdale, AZ (US)

(72) Inventor: Phillip Dale Lott, Nashville, TN (US)

(73) Assignee: Fender Musical Instruments Corporation, Scottsdale, AZ (US)

( * ) Notice: Subject to any disclaimer, the term of this patent is extended or adjusted under 35 U.S.C. 154(b) by 0 days.

(21) Appl. No.: 15/160,689

(22) Filed: May 20, 2016

(65) Prior Publication Data

US 2016/0345096 A1 Nov. 24, 2016

Related U.S. Application Data

(60) Provisional application No. 62/164,332, filed on May 20, 2015.

(51) Int. Cl.

| | |
|---|---|
| ***H04R 5/02*** | (2006.01) |
| ***H04R 5/04*** | (2006.01) |
| ***H04R 3/00*** | (2006.01) |
| ***H04S 1/00*** | (2006.01) |

(52) U.S. Cl.

CPC ..... *H04R 5/04* (2013.01); *H04R 3/005* (2013.01); *H04S 1/005* (2013.01); *H04R 2420/07* (2013.01)

(58) Field of Classification Search

CPC ... G06F 1/1656; G06F 21/86; H04R 2420/07; H04R 3/005; H04R 5/04; H04S 1/005; H04B 5/00; H04B 5/0012; H04B 5/02; H04B 1/385; H04M 1/05; H04M 1/6058; H04M 1/6066

USPC ... 381/311, 315, 56, 74, 111, 300, 312, 314, 381/328, 370, 376, 380; 455/41.1, 41.2, 455/66, 575.2

See application file for complete search history.

(56) References Cited

U.S. PATENT DOCUMENTS

| | | | | |
|---|---|---|---|---|
| 6,424,820 | B1 | 7/2002 | Burdick et al. | |
| 8,494,198 | B2 | 7/2013 | Aldaz et al. | |
| 2006/0039577 | A1* | 2/2006 | Sanguino | H04R 25/554 381/315 |
| 2006/0073787 | A1* | 4/2006 | Lair | H04M 1/6066 455/41.1 |
| 2012/0148077 | A1* | 6/2012 | Aldaz | H04R 25/558 381/315 |
| 2012/0283593 | A1 | 11/2012 | Searchfield et al. | |
| 2014/0152405 | A1 | 6/2014 | Huh et al. | |
| 2014/0169596 | A1 | 6/2014 | Lunner et al. | |

(Continued)

FOREIGN PATENT DOCUMENTS

WO 2008/113053 A1 9/2008

OTHER PUBLICATIONS

NXP Announces Ultra-Low Power Radio Transceiver Enabling Truly Wireless Earbuds, Eindhoven, Netherlands, Feb. 26, 2015 (Globe Newswire).*

*Primary Examiner* — Xu Mei
*Assistant Examiner* — Friedrich W Fahnert
(74) *Attorney, Agent, or Firm* — Hall Estill Attorneys at Law

(57) ABSTRACT

A wireless audio system may be configured with a mobile communication device that is concurrently wirelessly connected to first and second monitors, respectively, via first and second wireless pathways. The first and second wireless pathways can be different and provide stereo audio reproduction with the first and second monitors with 5 ms of latency or less.

20 Claims, 4 Drawing Sheets

(56) References Cited

U.S. PATENT DOCUMENTS

| | | | | |
|---|---|---|---|---|
| 2016/0072558 | A1* | 3/2016 | Hirsch | H04B 5/0081 455/41.1 |
| 2016/0105924 | A1* | 4/2016 | Baek | H04W 4/008 455/41.2 |
| 2017/0040696 | A1* | 2/2017 | Peralta | H01Q 7/005 |
| 2017/0070801 | A1* | 3/2017 | Nguyen | H04R 1/105 |
| 2017/0078809 | A1* | 3/2017 | Solum | H04R 25/554 |

* cited by examiner

WIRELESS AUDIO SYSTEM

RELATED APPLICATION

The present application makes a claim of domestic priority to U.S. Provisional Patent Application No. 62/164,332 filed May 20, 2015, the contents of which are hereby incorporated by reference.

SUMMARY

A wireless audio system, in accordance with some embodiments, has a mobile communication device that is concurrently wirelessly connected to first and second monitors, respectively, via first and second wireless pathways. The first and second wireless pathways are different and provide stereo audio reproduction with the first and second monitors with 5 ms of latency or less.

DETAILED DESCRIPTION

The proliferation of mobile computing devices that have reduced physical size and sophisticated computing capabilities has increased consumer demand for wireless headphone systems that provide robust audio quality and near zero signal latency. For example, performing artists could utilize wireless headphones to receive feedback during a concert. However, conventional wireless headphone technology has an inherent signal latency, which can be particularly long when a signal is passing through a user's head. Thus, there is an industry and consumer interest in optimizing personal wireless audio communication by decreasing signal latency.

It is initially noted that the term "monitor" and "headphone" are used synonymously throughout the present disclosure. While not limiting, a monitor is herein meant as a signal reproducing device that may be positioned partially or completely in one or more user's ears (in-ear) or may be positioned proximal at least one ear of the user (over ear or on ear). When a monitor is connected to an audio signal source, such as an amplifier, processor, and/or computer memory via a tangible wire, audio signals are transmitted with characteristics determined by the wire, such as resistance and length. In contrast, wireless audio signal transmission has a plurality of variables that collectively determine signal transmission speed and quality.

Musicians, commuters, audiophiles, and consumers who own custom or generic monitors are interested in utilizing the audio reproduction capabilities in situations other than listening to music or speech. For instance, a continued goal of the headphone market is to utilize wireless monitors in combination with microphones for noise-reduction, enhanced hearing, and the production of audio signals, like voice feedback. Accordingly, various embodiments configure a wireless audio system that provides low signal latency along with a diverse range of capabilities that may, or may not, be facilitated by attachments physically connected to a wireless monitor.

Figure 1:
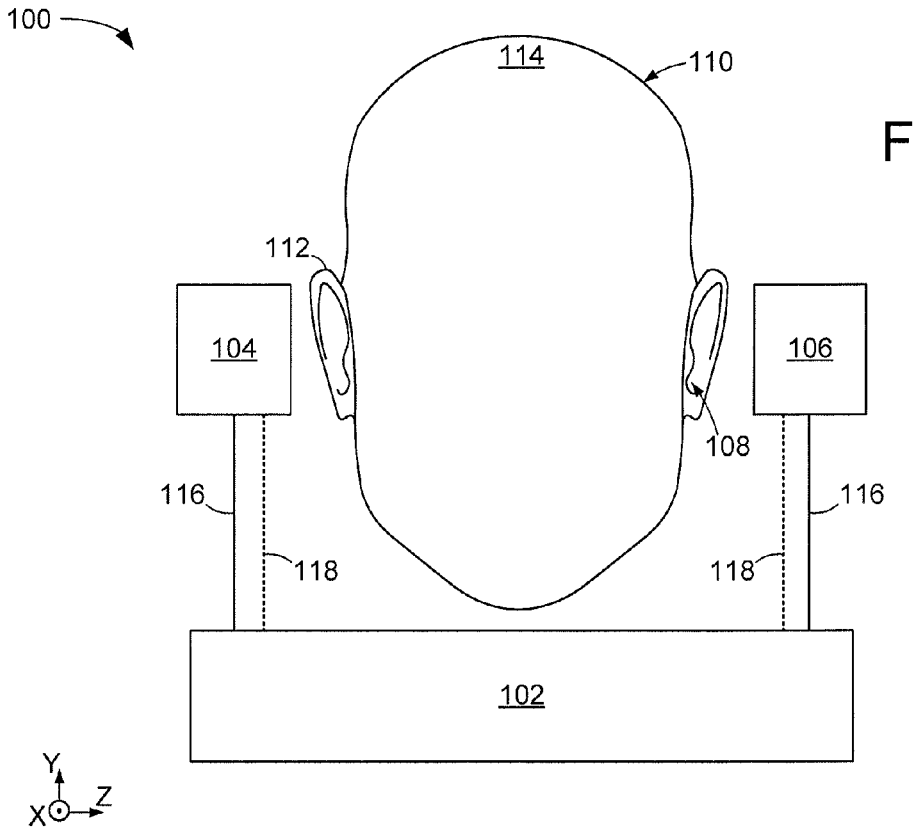
FIG. 1 is a line representation of an example wireless audio system arranged in accordance with some embodiments.

FIG. 1 illustrates a line representation of an example audio system 100 arranged in accordance with assorted embodiments. As shown, an audio source 102 is connected to first 104 and second 106 audio reproducing monitors positioned proximal ear canals 108 of a user 110. It is contemplated that the monitors 104 and 106 are respectively positioned in, on, or over ears 112 located on opposite sides of the user's head 114.

While stereo audio reproduction is possible via wired 116 connection of the monitors 104 and 106 to the source 102, wireless connection, as represented by segmented line 118, has been limited to a single monitor or a wired interconnection between the monitors 104 and 106. In other words, stereo audio reproduction has not been capable with two non-wired monitors 104 and 106 due at least in part to the interference incurred during passage of wireless signals through the user's head 114. Such interference can result in latency that delays one monitor 104 with respect to the other monitor 106, which can be disorienting, confusing, and annoying to the user 110.

Figure 2:
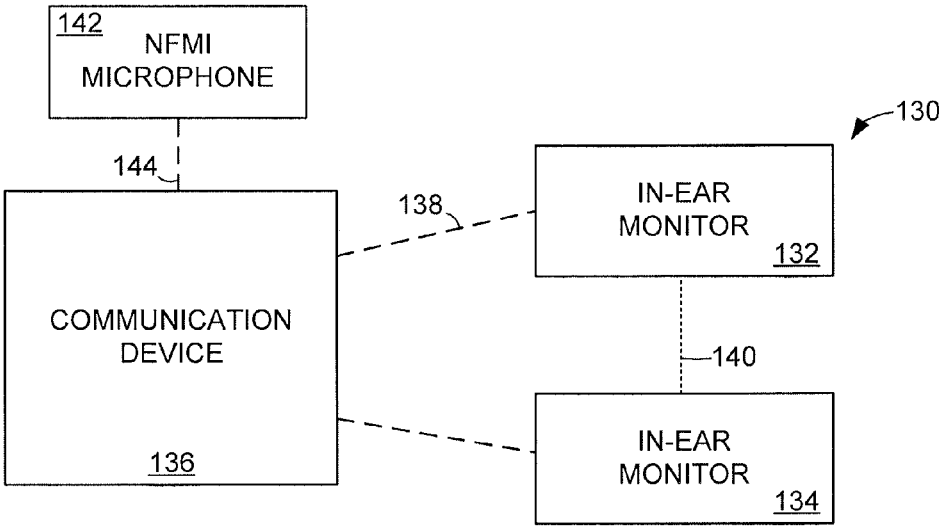
FIG. 2 displays a block representation of an example wireless audio system configured in accordance with various embodiments.

Although mono wireless audio reproduction via a single wireless monitor 104 can be conducted in some situations, some embodiments provide the ability to produce stereo wireless audio reproduction with near zero latency, as defined as latency substantially close to latency experienced with the wired connection 116, which optimizes the listening environment and experience for the user 110. FIG. 2 is a block representation of an example wireless audio system 130 configured in accordance with some embodiments to provide wireless stereo audio reproduction with without latency noticeable by a user. The wireless audio system 130 has first 132 and second 134 in-ear monitors that are each connected to a common communication device 136 by at least one wireless pathway 138.

While the in-ear monitors 132 and 134 may be connected via a wired interconnection, various embodiments provide a wireless monitor interconnection 140 that is provided by the same, or different, wireless technology that provides the wireless pathway 138 to the communication device. It is contemplated that the in-ear monitors 132 and 134 may be on ear or over ear headphones, without limitation. It is further contemplated that the communication device 136 is mobile, worn by a user, can operate with and without a wired audio source, and can be adapted to provide a multitude of uses for the in-ear monitors 132 and 134 to accommodate a diverse variety of environments.

The communication device 136 may be connected to one or more near field magnetic induction (NFMI) microphones 142 via a third wireless pathway 144 that may be similar, or dissimilar, from pathways 138 and 140. The NFMI microphone 142 may be physically, electronically, and/or wirelessly separate from the in-ear monitors 132 and 134. As such, the communication device 136 may operate with the NFMI microphone 142 without the in-ear monitors 132 and 134 being present or activated. The wireless pathway 144 may connect to an analog-to-digital (A/D) converter, in the event the microphone 142 is analog, or to an NFMI processor of the communication device 136 prior to being transmitted within the communication device 136 to an NFMI receiver via one or more antennae.

The ability to independently connect at least one microphone to the communication device 136 via an NFMI pathway 144 prevents radio frequency interference and allows long range wireless circuits in the communication device 136 to further transmit the microphone signals to a remote location, such as a tower positioned more than 10 meters away. That is, the NFMI signal from the microphone 142 is a non-propagating signal that has a short range, such as less than 3 meters, low signal latency, and very low power consumption that can survive radio frequency interference, but needs to be translated into a long range signal by the communication device 136 to enable communication with a distant station.

Figure 3:
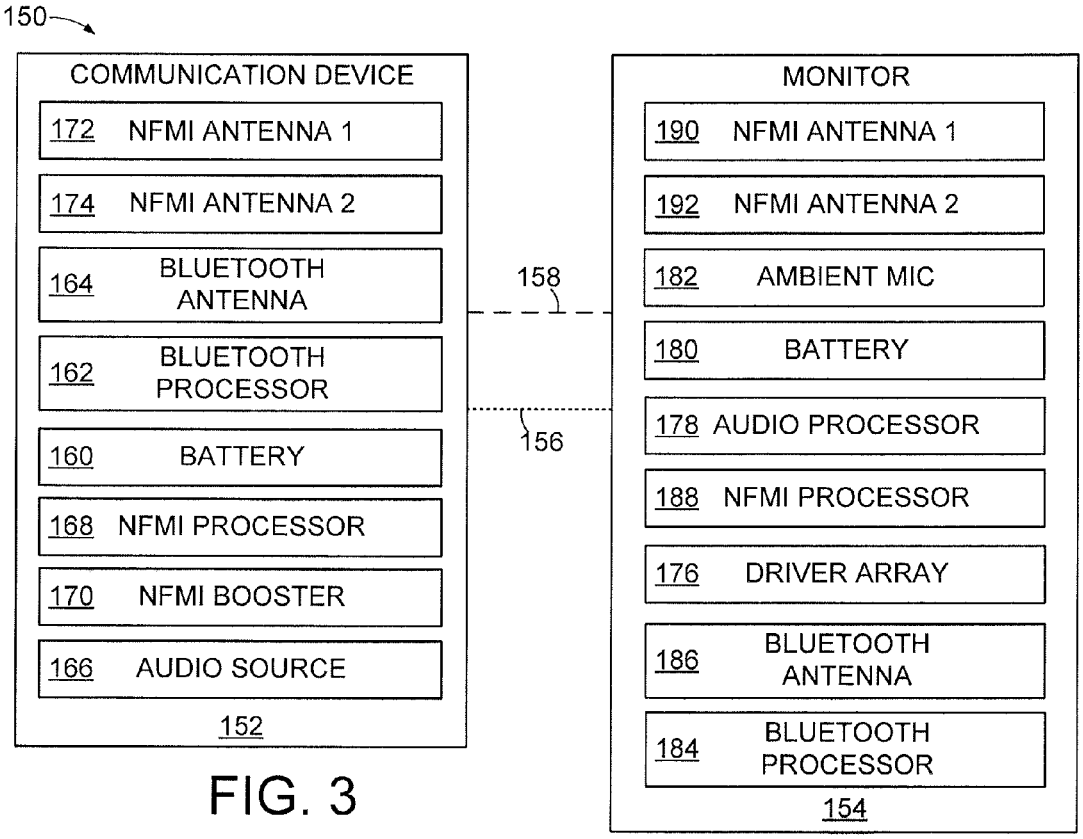
FIG. 3 illustrates a block representation of a portion of an example wireless audio system constructed and operated in accordance with assorted embodiments.

FIG. 3 displays a block representation of a portion of an example wireless audio system 150 configured in accordance with some embodiments. A communication device 152 is shown wirelessly connected to a monitor 154, such as an in-ear monitor 132 of FIG. 2, via first 156 and second 158 wireless connections. It is noted that the wireless audio system 150 may employ monitors 154 that are configured differently, or with matching circuitry.

The communication device 152 may be formed to fit on the hip, arm, leg, shoulder, or neck of a user with a plurality of different circuitry configured to provide mobile wireless operation. In the non-limiting embodiments shown in FIG. 3, the communication device 152 has at least one battery 160 that provides electrical power to the various active and passive aspects of the device 152. It is contemplated that the battery 160 is removable and/or rechargeable, such as via a charging port on the exterior of the communication device. In some embodiments, the first wireless connection 156 is a secured wireless pathway, such as a Bluetooth pathway, that is facilitated by a secured wireless processor 162 and at least one secured wireless antenna 164 to provide 8-64 bit streaming digital audio from an audio source 166, such as a local memory card like an SD card or a wireless internet connection.

The use of a secured wireless connection 156 can provide a single audio stream to the monitor 154, but stereo audio reproduction with multiple monitors 154 is difficult with high latency rates. Thus, the communication device 152 is configured with a near field magnetic induction (NFMI) processor 168 and may use one or more NFMI boosters 170 that establish an NFMI wireless connection 158 via one or more NFMI antennae, which may include first 172 and second 174 NFMI antennae. It is noted that the NFMI connection 158 is immune to radio frequencies and has a short range with low power consumption by communicating via non-propagating magnetic fields. Although not required when a single NFMI antenna is employed, the utilization of multiple NFMI antennae 172 and 174 provides diversity that allows concurrent, individual, and redundant operation to one or more monitors 154 to provide stereo audio reproduction with 5 ms of latency or less.

The concurrent use of different wireless connections 156 and 158 between the communication device 152 and monitor 154 allows each monitor 154 to utilize multiple different signals to produce at least CD quality audio, such as 44.1 kHz 16 bit audio, via one or more driver arrays 176. The monitor 154 is constructed with an audio processor 178 that is powered by at least one battery 180 that can be recharged and/or removed at will. The audio processor 178 may be adapted to provide the production of audio via the driver array 176 as well as the reception of audio via one or more microphones, such as an ambient microphone 182. That is, the audio processor 178 can consist of several different audio circuits, such as an analog-to-digital converter, digital-to-analog converter, and amplifier, to concurrently or independently produce audio to a user or collect audio from the user and/or the environment around the user.

The incorporation of a microphone 182 can allow the monitor 154, alone or in combination with the communication device 152, to reduce or eliminate background noise either passively or actively. In other words, the microphone 182 can indicate the noise present around a user and allow the audio processor 178 to generate countermeasures to reduce the amount, volume, and/or severity of the noise, which enhances the user's audio listening experience. Each monitor 154 is equipped with means to establish, transmit, and receive Bluetooth and NFMI signals. Such means may consist of at least a secured wireless processor 184, secured wireless antenna 186, NFMI processor 188, and NFMI antenna, which may be a single NFMI antenna or the first 190 and second 192 NFMI antennae displayed in FIG. 3.

With the various components and circuitry of the communication device 152 and monitor 154, the first 156 and second 158 wireless connections can be established and maintained to provide stereo audio reproduction without the monitor 154 being wired to another monitor 154 or the communication device 152. It is noted that the NFMI processor 188 may be a transceiver that can concurrently or independently transmit and receive signals and functions from a common semiconductor chip. The lack of any external wires extending from the monitor 154 provides increased user comfort and listening experience as an ear canal portion of the monitor 154 can be custom fitted, or generically molded, without worrying about the where wires are going to be positioned relative to a user's ear. As such, the ear canal can be sealed by the wireless monitor 154 better than an in-ear headphone having wires extending from the user's ear.

Figure 4:
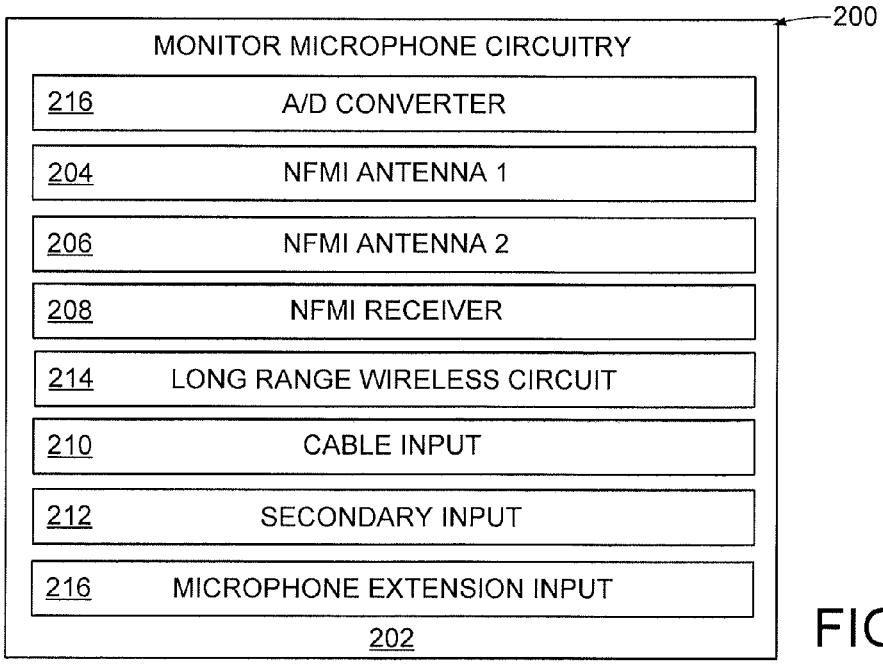
FIG. 4 shows a block representation of a portion of an example wireless audio system arranged in accordance with some embodiments.

FIG. 4 is a block representation of an example monitor microphone system 200 that may be employed in a wireless audio system in accordance with various embodiments. The microphone system 200 can have one or more monitor microphone circuits 202 that have one or more signal inputs into an in-ear, on ear, or over ear monitor. For example, the microphone circuitry 202 can have first 204 and second 206 NFMI antennae to input NFMI signals to an NFMI receiver 208. As another non-limiting example, the microphone circuitry 202 can consist of a cable input 210 that allows cables, such as 2.5-4.4 mm diameter input/output connectors that may be balanced, to be connected to provide wired operation that may be conducive to assorted situations, such as high amplification environments and locations where wireless communication is restricted, like on airplanes. The ability to connect cables further allows a user to convert from wireless to wired operation without having to install or change a wireless communication add-on, such as a wireless transmitter.

The cable input 210 may be configured to allow an add-on cable to provide an array of different inputs to the microphone 200 as well as the wireless audio system. For example, the cable input 210 may be engaged to provide controls, such as an additional voice microphone, as well as direct wired connection to one or more monitors that can provide amplified direct audio. It is contemplated that a secondary input 212 is present on the microphone circuitry 200 or the communication device that may operate independently and concurrently with the cable input 210 to provide supplemental capabilities, such as an external power connection that recharges the wireless audio system, pass-through audio, voice recognition, and active noise reduction. The inputs 210 and 212 can be adapted for wired and/or wireless connection with audio sources directly, such as cellular phones, watches, tablets, and laptop computers, instead of the audio source being connected to the communication device 152. A long range wireless circuit 214 can provide extended range for the monitor and independent wireless connections, such as cellular, irrespective of the connections established with the communication device 152.

The physical configuration of a monitor can be adapted to allow a microphone extension 216 to be attached. A microphone extension 216 can be any shape and size, but in various embodiments is a combination of boom microphone that continuously extends proximal a user's mouth from an ear hook that secures the wireless monitor into the user's ear. It is contemplated that a microphone extension has an auxiliary battery that can be removed and/or recharged to provide additional life to the wireless monitor. The ability to configure a monitor with one or more microphones and inputs that generate audio signals is facilitated by an A/D converter that translates received signals into digital communication that can be processed for enhancement, amplification, and/or cancellation.

Figure 5:
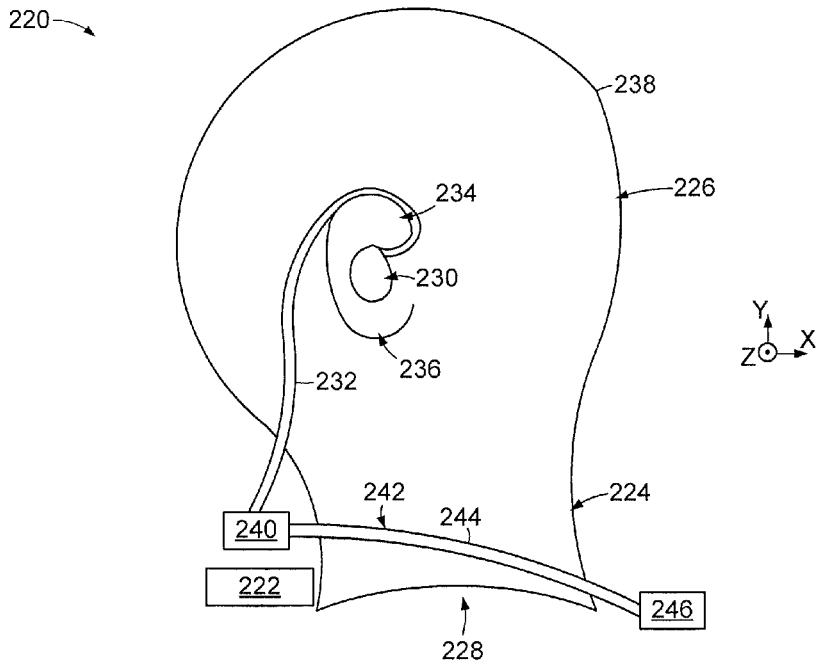
FIG. 5 depicts a line representation of a portion of an example wireless audio system configured in accordance with various embodiments.

FIG. 5 depicts a line representation of a portion of an example wireless audio system 220 constructed and operated in accordance with some embodiments. As shown, a communication device 222 is positioned proximal the neck 224 of a user 226. The communication device 222 may be adapted to fit around the neck 224 of the user 226, which may, or may not, involve contact with a shoulder 228 of the user 226. Despite the close physical proximity, the communication device 222 is physically separated from first 230 and second (not shown) in-ear monitors that are each wireless and respectively positioned in contact with the ear canal of the user 226.

While the first 230 and second in-ear monitors are wireless and have no external wires, a user may, in various embodiments, attach one or more auxiliary extensions 232 to the respective monitors 230 to provide additional fitment and features. A non-limiting example of an auxiliary extension 232 is the microphone extension 214 of FIG. 4. In the non-limiting embodiment shown in FIG. 5, the auxiliary extension 232 continuously extends from each in-ear monitor 230 around the forward helix 234 of the user's ear 236 to a position below the user's head 238 and proximal the user's neck 224. The shape, size, and position of the auxiliary extension 232 can be tuned, without limitation, to provide comfort specific to certain activities, such as playing sports like golf.

The auxiliary extension 232 may also be tuned to provide an electrical circuit 240 to support one, or both, in-ear monitors 230. In some embodiments, the electrical circuit 240 is physically secured to the user via one or more clips, clasps, and/or surfaces to provide an additional battery while other embodiments provides an NFMI booster to strengthen the signal and reduce latency between the in-ear monitors 230. It is contemplated that the user 226 can selectively remove the auxiliary extension 232 from the in-ear monitors 230, which provides the ability to utilize the physical and electrical aspects of the auxiliary extension 232 at will.

The auxiliary extension 232 may have multiple interconnected modular pieces that physically and/or electrically interconnect to provide additional comfort and/or optimized wireless audio reproduction from the in-ear monitors 230. For instance, a secondary portion 242 can selectively attach to a band 244 of the auxiliary extension 232 to provide control circuitry 244 in an easy accessible region of the user's shoulder 228. It is noted that the control circuitry 246 may consist of any number of sensors, such as buttons, microphones to receive voice commands, and proximity sensors to detect hand gestures as audio reproduction controls. The position of the control circuitry 246 may be adapted to provide stand-alone or additional microphones that facilitate the wireless audio system 220 being employed to record and/or transmit the user's speech.

The ability to modularly interconnect the auxiliary extension 232 with the secondary portion 242 allows the wireless audio system 220 to be adapted to a diverse range of user preferences for performance, fitment, and capabilities. It is noted that the various aspects of the wireless audio system 220 shown in FIG. 5 do not electrically interconnect the in-ear monitors 230 with a communication device, which may be worn on a user's belt or present in the pocket or purse of the user 226. However, it is contemplated that the communication device is secured proximal the user's neck 224, such as with a clip or magnetic clasp, without electrically being connected to the auxiliary extension 232 or in-ear monitors 230.

Figure 6:
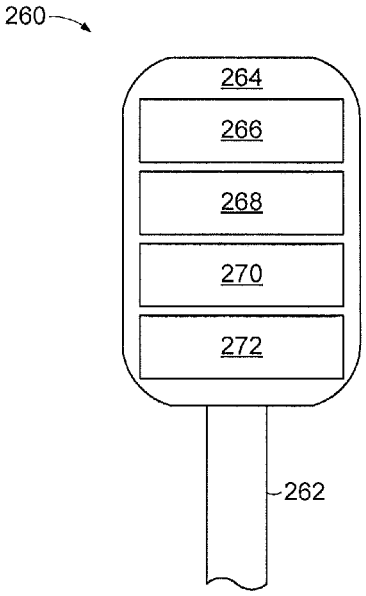
FIG. 6 conveys a line representation of a portion of an example wireless audio system constructed and operated in accordance with assorted embodiments.

FIG. 6 is a top view line representation of a portion of an example secondary portion 260 that may be incorporated into a wireless audio system in accordance with various embodiments. The secondary portion 260 consists of a protrusion 262 that can be flexible, rigid, or semi-rigid and extend from a control box 264. The protrusion 262 may be a wire, tube, or combination thereof that allows a user to adjust the fitment and position of the control box 264 proximal the user's neck or shoulder. Although the protrusion 262 may provide ample stability for the control box 264, one or more securement features 266 can attach the protrusion 262 and/or control box 264 to a user's garment, such as a shirt, coat, backpack, and scarf with any variety of mechanical, friction, and magnetic clips, clasps, or surfaces.

The control box 264, in some embodiments, has an ambient microphone 268 for enhanced noise reduction in combination with a voice microphone 270 that provides enhanced voice signal clarity and strength. It is noted that the microphones 268 and 270 of the control box 264 may be processed individually or in concert with one or more microphones present in in-ear monitors positioned in a user's ear. Likewise, the control box 264 may have at least one control sensor 272 that allows the user to interact with the wireless audio system. For instance, any number of buttons, knobs, slides, and surfaces can be used to allow the user to manipulate the function of the wireless audio system. By placing the control box 264 away from the user's ear, control and performance of the wireless audio system can be more efficiently executed compared to if the user would have to reach the in-ear monitor or communication device stored in a pocket, for example.

Figure 7:
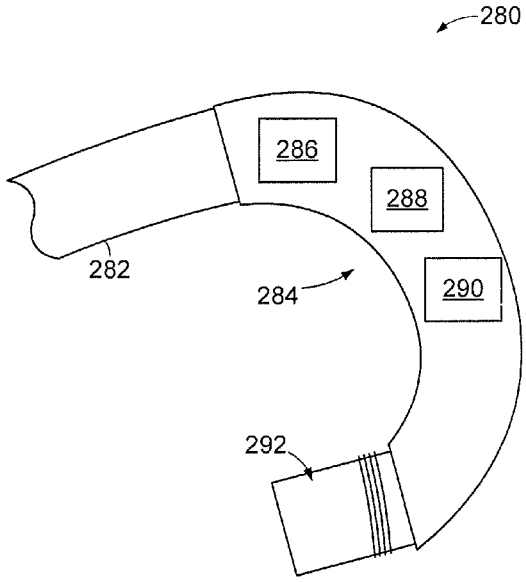
FIG. 7 is a line representation of a portion of an example wireless audio system arranged in accordance with some embodiments.

FIG. 7 displays a side view line representation of a portion of an example auxiliary extension 280 that can be selectively attached to an in-ear monitor in accordance with assorted embodiments. The auxiliary extension 280 has a cable 282 that may be flexible or rigidly secured in an encasement. The cable 282 extends from an ear hook portion 284 that is adapted to rest in contact with the forward pima portion of the user's ear along with a portion of the user's head. The ear hook portion 284 can counteract gravity and provide increased securement of an in-ear monitor in addition to increased comfort when the ear hook portion 284 is shaped by the user or by a professional fitter.

In some embodiments, the ear hook portion 284 has one or more controls 286, such as buttons or sensors. In other embodiments, the ear hook portion 284 comprises at least one microphone 288 configured to allow pass-through audio that optimizes a user's listening experience. That is, a pass-through microphone 288 can collect background and environment sounds that are reproduced via the in-ear monitor to engage the user in the surrounding environment. As an example, the pass-through microphone 288 can allow a wireless audio system to act as hearing protection by reducing exterior sounds, act as hearing enhancement by increasing exterior sounds, and act as a conduit to allow the user to listen to audio signals without being disconnected with the surrounding environment.

It is contemplated that the ear hook portion 284 has one or more vibration sensors 290 tuned to recognize and discern a user's jaw movement to distinguish commands, speech, and clinical conditions. For instance, a vibration sensor 290 can operate in concert with predictive and/or reactive software resident in the communication device to sense when a user is speaking, moving a mandible to execute a command, whispering, or grinding teeth, which can be used to optimize audio reproduction by adjusting audio volume, suspending audio playback, and/or recognizing commands that would not be accurately recognized by microphones or sensors positioned distal the user's jaw.

The ear hook portion 284 is shown with a physical connector 292 that establishes an electrical connection with the in-ear monitor. The connector 292 may be a standardized configuration, such as an MMCX, IEM 2-pin connector, or may be an inductive connector that employs magnetic surfaces to secure the ear hook portion 284 and establish an electrical connection. It is contemplated that the connector 292 is selectively attachable and can be disconnected at will without degrading or interrupting the operation of an in-ear monitor.

Figure 8:
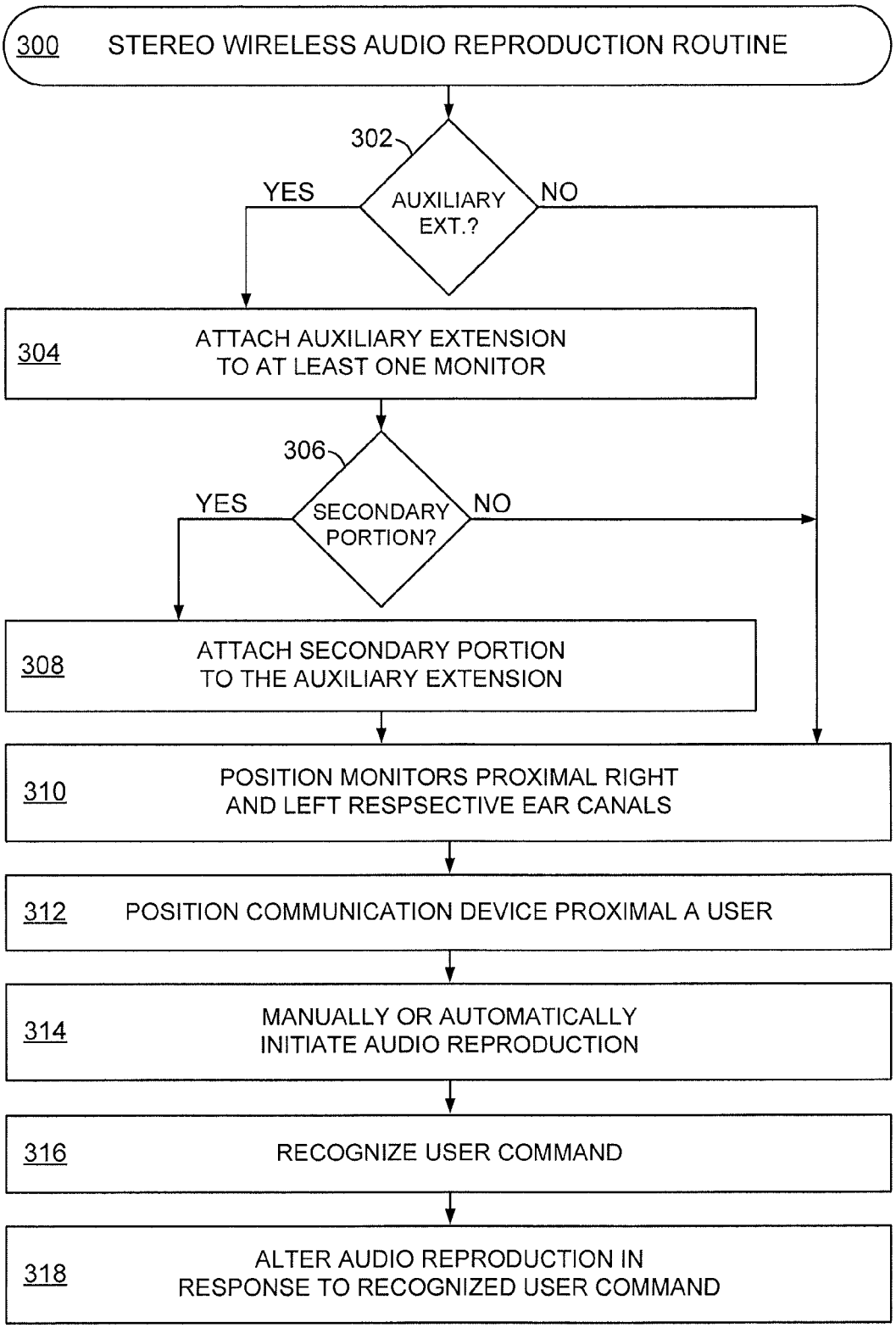
FIG. 8 provides a flowchart of an example stereo wireless reproduction routine that may be carried out in accordance with various embodiments.

FIG. 8 is a flowchart of an example stereo wireless audio reproduction routine 300 that can be executed by a wireless audio system with a pair of wireless monitors and at least one communication device. The routine 300 begins by physically configuring a wireless audio system. Decision 302 evaluates if an auxiliary extension is to be incorporated into the wireless audio system. If so, step 304 attaches an auxiliary extension to at least one in-ear monitor. Step 304 may additionally involve shaping the auxiliary extension to provide a custom, comfortable fit. The inclusion of the auxiliary extension allows decision 306 to determine if a secondary portion is to be attached. Confirmation of decision 306 advances to step 308 where at least one secondary portion is physically and electrically connected to the auxiliary extension.

It is noted that steps 304 and 308 can individually or collectively secure the auxiliary extension and/or secondary portion to one or more articles of clothing of a user via clips, clasps, magnets, and pins. In a non-limiting example, the auxiliary extension is magnetically secured to the collar of a user's shirt and the secondary portion is secured in place via a high friction surface that contacts the user's shirt. In the event decision 302 or 304 do not incorporate additional physical structure, step 310 positions in-ear monitors into respective left and right ears of the user so that an ear tip portion of each monitor is in contact with an ear canal. It is contemplated that one, or both, in-ear monitors are secured in the user's ear via seals, tips, hooks, loops, and protrusions that engage various portions of the user's ear, such as the helix and tragus.

With the respective in-ear monitors positioned in the user's ears, a communication device is positioned proximal the user in step 312 to form first and second wireless connections with each of the left and right in-ear monitors. It is contemplated that the communication system and in-ear monitors are configured to recognize installation and automatically turn on when positioned within a certain distance, such as four feet. Such automatic activation may also automatically or manually initiate stereo audio reproduction via the in-ear monitors in step 314. Although not limiting, transmitting audio signals from the communication device via secured wireless signals and coupling the respective in-ear monitors via NFMI signals emanating from one or more NFMI antennae facilitate stereo audio reproduction.

The stereo audio reproduction may involve listening to music or speech provided by an audio source, conducting cellular communications, or performing at a concert with feedback audio. At some point after stereo audio reproduction is initiated in step 314, step 316 proceeds to recognize a user command, such as a gesture, voice command, or button contact, that is recognized and results in step 318 altering the audio reproduction in accordance with the command. For example, the user command in step 316 may adjust volume, audio source, system function, or turn off.

It is to be understood that even though numerous characteristics of various embodiments of the present disclosure have been set forth in the foregoing description, together with details of the structure and function of various embodiments, this detailed description is illustrative only, and changes may be made in detail, especially in matters of structure and arrangements of parts within the principles of the present technology to the full extent indicated by the broad general meaning of the terms in which the appended claims are expressed. For example, the particular elements may vary depending on the particular application without departing from the spirit and scope of the present disclosure.

Although not required or limiting, various embodiments physically separate in-ear monitors without any wires extending therebetween. An ambient microphone array can be incorporated into a monitor, communication device, or both, to provide feedback to user, cancel noise, allow voice engagement, and optimize listening sound with respect to the exterior environment, such as by automatically adjusting volume, bass, or pressure in response sensed conditions.

One or more rechargeable batteries can provide power to a monitor, microphone, and/or communication device. A monitor can be configured with a driver array that consists of more than one different audio driver, such as a dynamic driver combined with a balanced armature driver. At least one audio processor may be incorporated into an audio system. An audio processor may be an amplifier digital-to-analog converter (DAC), a digital equalizer, an ambient microphone controller, voice recognition software, and an audio encryption controller.

What is claimed is:

1. An apparatus comprising a communication device connected to a first audio reproducing monitor via a first wireless pathway and to a second audio reproducing monitor via a second wireless pathway, each wireless pathway communicating between a first near field magnetic induction (NFMI) antenna of the communication device and a first NFMI receiver positioned in each of the respective audio reproducing monitors to provide stereo audio reproduction with 5 ms or less of signal latency, the first audio reproducing monitor comprising a second NFMI antenna connected to a second NFMI receiver of the communication device via a third wireless pathway, the second audio reproducing monitor comprising a third NFMI antenna connected to the second NFMI receiver via a fourth wireless pathway.

2. The apparatus of claim 1, wherein the communication device has a first NFMI processor connected to the first NFMI antenna and each audio reproducing monitor has a second NFMI processor respectively connected to the second and third NFMI antennae.

3. The apparatus of claim 1, wherein the communication device is physically separated from each audio reproducing monitor.

4. The apparatus of claim 1, wherein the third wireless pathway is concurrently present between the communication device and the first audio reproducing monitor while the fourth wireless pathway is present between the communication device and the second audio reproducing monitor.

5. The apparatus of claim 1, wherein the first and third wireless pathways concurrently redundant transmit signals between the communication device and the first audio reproducing monitor and the second and fourth wireless pathways concurrently transmit redundant signals between the communication device and the second audio reproducing monitor.

6. The apparatus of claim 1, wherein the third and fourth wireless pathways are each Bluetooth secured wireless pathways.

7. The apparatus of claim 1, wherein an NFMI microphone is wirelessly connected to the communication device via a fifth wireless pathway.

8. The apparatus of claim 7, wherein the NFMI microphone is physically attached to the first audio reproducing monitor.

9. The apparatus of claim 7, wherein the NFMI microphone has a cable port electrically connected to a source, the source being physically and electrically separate from the communication device.

10. The apparatus of claim 9, wherein the source is a battery.

11. A system comprising:

a communication device;

a first audio reproducing monitor connected to the communication device via a first wireless pathway;

a second audio reproducing monitor connected to the communication device via a second wireless pathway, each wireless pathway communicating between a near field magnetic induction (NFMI) antenna and a NFMI receiver to provide stereo audio reproduction with 5 ms or less of signal latency; and an extension physically attached to the first audio reproducing monitor and continuously extending to an area below a head of a user, the extension being physically separate from the communication device.

12. The system of claim 11, wherein the extension consists of at least one electrical circuit.

13. The system of claim 12, wherein the electrical circuit comprises a wireless signal booster.

14. The system of claim 12, wherein the electrical circuit is a battery.

15. The system of claim 11, wherein the extension comprises one or more buttons configured to alter the first and second wireless pathways.

16. The system of claim 11, wherein the extension comprises a microphone wirelessly connected to the communication device via a third wireless pathway.

17. The system of claim 11, wherein the extension comprises a proximity sensor configured to detect hand gestures of the user.

18. The system of claim 11, wherein the extension comprises a vibration sensor configured to detect when the user is speaking.

19. A method comprising:

connecting a communication device connected to a first audio reproducing monitor via a first wireless pathway;

forming a second wireless pathway between the communication device and a second audio reproducing monitor, each wireless pathway communicating between a first near field magnetic induction (NFMI) antenna in the communication device and a first NFMI receiver in the respective audio reproducing monitors;

connecting a second NFMI antenna of the communication device to a second NFMI receiver of the first audio reproducing monitor via a third wireless pathway;

forming a fourth wireless connection between the second NFMI antenna and a third NFMI receiver of the second audio reproducing monitor, the first and second wireless pathways concurrently transmitting different left and right audio signals, the third and fourth wireless connections concurrently transmitting a matching signal; and reproducing an audio signal in stereo with the first and second audio reproducing monitors with 5 ms or less of signal latency.

20. The method of claim 19, wherein the communication device is positioned on a user while being physically separated from each audio reproducing monitor.

* * * * *